US007850399B2

(12) United States Patent
Render

(10) Patent No.: US 7,850,399 B2
(45) Date of Patent: Dec. 14, 2010

(54) METHOD OF SPLICING PILE CAGES, SET OF COMPONENTS THEREFOR, AND ASSEMBLED PILE CAGES

(76) Inventor: Stephen Render, 15 Mill Fleam, Hilton, Derbyshire (GB) DE56 5HE ( * ) Notice: Subject to any disclaimer, the term of this patent is extended or adjusted under 35 U.S.C. 154(b) by 81 days.

(21) Appl. No.: 12/097,036

(22) PCT Filed: Dec. 12, 2006

(86) PCT No.: PCT/GB2006/004620

§ 371 (c)(1),
(2), (4) Date: Oct. 27, 2008

(87) PCT Pub. No.: WO2007/068898

PCT Pub. Date: Jun. 21, 2007

(65) Prior Publication Data

US 2009/0169310 A1 Jul. 2, 2009

(30) Foreign Application Priority Data

Dec. 12, 2005 (GB) ..... 0525216.8
Apr. 18, 2006 (GB) ..... 0607584.0

(51) Int. Cl.
*E02D 5/30* (2006.01)

(52) U.S. Cl. ..... 405/251; 405/239

(58) Field of Classification Search ..... 405/239, 405/250, 251, 231, 232
See application file for complete search history.

(56) References Cited

U.S. PATENT DOCUMENTS 1,048,993 A * 12/1912 Meriwether ..... 405/253
1,653,055 A 12/1927 Macomber
3,316,724 A * 5/1967 Tsuzuki ..... 405/251

(Continued)

FOREIGN PATENT DOCUMENTS

DE 1609657 B1 12/1971

(Continued)

*Primary Examiner*—Frederick L Lagman
(74) *Attorney, Agent, or Firm*—Pedersen and Company, PLLC; Ken J. Pedersen; Barbara S. Pedersen

(57) ABSTRACT

This invention relates to a method of splicing pile cages, to a set of components therefor, and to assembled pile cages, and in particular to a method of splicing together two pile cages of a reinforced concrete pile. The method employs two pile cages which are each assembled from a number of cage bars and at least one frame, one of the pile cages having a suspension band adjacent to one of its ends, the other pile cage having at least one support plate adjacent to one of its ends, the support plate having a hole therethrough. One of the pile cages is lifted into a pile hole with its end projecting therefrom, and the second pile cage is lifted over the first pile cage and lowered until a part of the cage bars of the second pile cage overlap a part of the cage bars of the first pile cage, and the hole in the support plate lies below the suspension band. A suspension bolt is inserted through the hole in the support plate so that a part of the suspension bolt lies underneath a part of the suspension band, whereby the first and second pile cages can be lifted together with the suspension bolt engaging the suspension band.

19 Claims, 2 Drawing Sheets

U.S. PATENT DOCUMENTS 3,934,422 A * 1/1976 Fredrickson et al. ..... 405/225
4,413,927 A * 11/1983 Silvander ..... 405/252
4,627,211 A * 12/1986 Foster, Jr. ..... 52/649.7
4,797,037 A * 1/1989 Hong ..... 405/255
5,542,785 A * 8/1996 Cloud ..... 405/239
6,860,077 B2 * 3/2005 Yin ..... 52/649.4

FOREIGN PATENT DOCUMENTS

DE 3000605 A1 9/1981
GB 0196542 A 10/1986
GB 2235223 A 2/1991

* cited by examiner

METHOD OF SPLICING PILE CAGES, SET OF COMPONENTS THEREFOR, AND ASSEMBLED PILE CAGES

FIELD OF THE INVENTION

This invention relates to a method of splicing pile cages, to a set of components therefor, and to assembled pile cages, and in particular to a method of splicing together two pile cages of a reinforced concrete pile.

In the following description, directional and orientational terms such as "top", "upper" etc. refer to the normal orientation of use, as represented in FIG. 1.

BACKGROUND TO THE INVENTION

Reinforced concrete piles are known for use in the foundations of roadway bridges and the like. The piles are sunk deep into the ground and can for example provide a link between the bridge supports and the underlying rocks. The pile comprises a metallic pile cage embedded in concrete, the pile cage acting both as a reinforcement for the concrete and also as a means to tie the bridge support or the like to the pile. The pile cage comprises a number of cage bars which in use are arranged to lie substantially along the longitudinal axis of the pile. These bars are interconnected by one or more frames which maintain the separation and alignment of the cage bars, and in many designs of pile cage the frame comprises a helical wire which surrounds and interconnects the cage bars.

Often the cage is assembled off-site at a dedicated manufacturing plant, and is delivered to the site for insertion into the hole created for the pile.

If the depth of the pile is greater than the length of the available pile cages, then the piling contractor will have to splice together two or more pile cages, i.e. connect the top end of a lower pile cage to the bottom end of an upper pile cage.

The pile cage is lowered into a hole which has been drilled into the ground by a drill or augur. The pile cage can be pressed down into wet concrete, the concrete being pumped into the hole as the augur is removed therefrom. Alternatively, a casing is inserted into the hole and the pile cage is inserted into the casing, the concrete then being poured around the pile cage and the casing subsequently being removed (so that it can be reused). A casing will typically be used when the pile cages are required to be spliced.

When two pile cages are to be spliced together, the helical wire of one or both of the pile cages will typically be terminated away from the end of the cage bars, so that the cage bars project beyond the helical wire and allow an overlap to be created between the cage bars of the respective pile cages, the length of overlap required being determined in advance by the piling contractor.

DESCRIPTION OF THE PRIOR ART

The pile cages will typically be spliced together on site by the piling contractor. Usually, the lower pile cage is fitted with a "trapping band" adjacent its upper end, i.e. a substantially circular band which is securely connected to the cage bars. This pile cage is lowered into the casing and a trapping bar or the like is laid across the top of the casing and underneath the trapping band so as to prevent the pile cage from falling into the casing and to hold the lower pile cage with a desired length projecting above the casing. The upper pile cage is then lifted by a crane over the casing and lowered until its cage bars overlap the projecting cage bars of the lower pile cage by the required distance, the upper pile cage being held in that suspended position whilst a number of U-bolts are located around adjacent cage bars of the upper and lower pile cages, the U-bolts and their cooperating saddles or plates being used to secure those cage bars (and ultimately the pile cages) together.

When the pile cages have been secured together the upper pile cage can be lifted (together with the lower pile cage) by a small distance allowing the trapping bar to be removed and the spliced pile cages are then lowered together into the casing.

The same procedure can be applied to add a third (and successive) pile cages, as desired or required for a particular pile.

It will be recognised that the splicing of the pile cages together does not serve the purpose of transmitting the tensile stress from one pile cage to another in use, the transmission of stress instead being achieved by the concrete which surrounds the overlapping length of the respective cage bars.

Piling contractors are becoming increasingly aware that the location of U-bolts onto the cage bars in the above-described method is potentially dangerous to the the operator. Specifically, the operator is required to place his or her hands between the cage bars in order to locate the U-bolt and subsequently to fit the saddle or plate and then fit and tighten the nuts, all of this taking place whilst the lower pile cage is supported by the trapping bar and trapping band, and the upper pile cage is suspended from the crane. Should there be a failure in any of the supporting componentry and one or both of the pile cages move during the location and subsequent tightening of a U-bolt the operator is likely to be injured, and when the significant weight of the pile cages is considered the injury is likely to be considerable (the amputation of the operator's hand or part of the operator's arm during such a procedure is not unknown).

For this reason, the regulatory bodies responsible for health and safety at work are becoming increasingly concerned about the continuing practice of the above-described method of splicing pile cages.

A second disadvantage of this method of splicing is the time taken to locate and tighten the U-bolts. For example, a 10-tonne pile cage may have 24 cage bars and to splice together two such pile cages it is usually necessary to fit 12 U-bolts and subsequently to fit 12 saddles or plates, and then fit and tighten 24 nuts. The U-bolts function by clamping two cage bars together principally by way of a frictional engagement between the cage bars, and to achieve the security required the nuts must be tightened to a required torque. Also, it is a feature of U-bolts that as the nut on one arm of the U is tightened the nut on the other arm becomes loose so that the correct tightening of both nuts of each U-bolt requires the operator to alternate between the nuts, perhaps several times. As the operator is aware of the danger he or she is in whilst the tightening operation is carried out many operators seek to short-circuit the procedure and often many of the nuts are inadequately tightened, resulting in considerable danger of an accident when the pile cages are subsequently lifted together.

Also, the time taken for the splicing operation is one of the key considerations for the piling contractor, as the splicing is carried out over the casing and the concrete cannot be poured until the spliced pile cage is in place. Any delays in the time taken to achieve the spliced joint impact significantly upon the costs incurred by the piling contractor.

Accordingly, both the operator and the piling contractor share a desire to speed up the fitment of the U-bolts, which desire is not conducive to the proper and secure fitment of the U-bolts.

An alternative method of splicing together two pile cages utilises couplers which connect the end of a cage bar of the upper pile cage to the end of a cage bar of the lower cage. A coupler provides a more secure connection than a U-bolt, but is considerably more expensive to purchase, requires considerably more control during manufacture of the pile cages, and also requires considerably more control over the relative positioning of the pile cages during the splicing operation. Thus, whilst with the method utilising U-bolts some accuracy is required in positioning the upper pile cage so that its (overlapping) cage bars lie sufficiently close to the cage bars of the lower pile cage to allow the fitment of the U-bolts, much more accuracy is required with the method utilising couplers to ensure that the end of a cage bar of the upper pile cage (which is suspended from a crane) is co-axially aligned with the end of a cage bar of the lower pile cage, and also that the separation between the ends of the respective cage bars is as required to allow the coupler to interconnect both cage bars.

It is also necessary to ensure that the pile cages are matched so that the couplers can be fitted on site, and this places extra burdens (and therefore costs) upon the pile cage manufacturer. Specifically, in order to ensure that the cage bars can be precisely aligned on site the pile cages which are to be spliced together are typically assembled together with the respective ends of the cage bars aligned. When the pile cages have been assembled one of the aligned cage bars of each pile cage must be painted or otherwise marked so that the piling contractor firstly knows which ends of the pile cages are to be spliced together, and secondly knows how to align the respective cages so that all of the cage bars are in alignment.

As well as the additional cost of the coupler itself, the ends of the cage bars must be threaded so as to allow connection to the coupler, which also adds to the cost of the assembled pile cage. Since the ends of the respective cage bars are not required to overlap when using a coupler there is a saving involved in using less of the material from which the cage bars are formed, but this saving is usually only a small proportion of the increased cost incurred in using the couplers.

In addition, the operator is still required to place his or her hands between the cage bars of the respective pile cages during fitment of the couplers, and the connection of a coupler is only slightly quicker than the fitment of a U-bolt, so that this second known method substantially shares the health and safety disadvantage of the first known method described above.

SUMMARY OF THE INVENTION

It is an object of the present invention to provide a method of splicing, and a set of components for use in that method, which avoids or reduces the disadvantages of the known methods.

According to the invention there is provided a method of splicing comprising the steps of: {i} assembling a first pile cage from a number of cage bars and at least one frame, the first pile cage having a suspension band adjacent to one of its ends, {ii} assembling a second pile cage from a number of cage bars and at least one frame, the second pile cage having at least one support plate adjacent to one of its ends, the support plate having a hole therethrough {iii} lifting the first pile cage and lowering this pile cage into a pile hole with its end having the suspension band uppermost, {iv} supporting the first pile cage with its uppermost end projecting from the pile hole and with the suspension band accessible, {v} lifting the second pile cage above the first pile cage and substantially coaxial therewith, with the end having the support plate lowermost, {vi} lowering the second pile cage relative to the first pile cage until a part of the cage bars of the second pile cage overlap a part of the cage bars of the first pile cage, and the hole in the support plate lies below the suspension band, {vii} inserting a suspension bolt through the hole in the support plate so that a part of the suspension bolt lies underneath a part of the suspension band, whereby the first and second pile cages can be lifted and lowered together with the suspension bolt engaging the suspension band and preventing separation of the first and second pile cages.

Accordingly, the provision of a suspension band on the first (lowermost) pile cage and a support plate on the second (uppermost) pile cage enables a quick and easy method of securing the two pile cages together by way of inserting the suspension bolt(s) when there is a sufficient overlap between the respective ends of the pile cages.

Preferably, the hole in the support plate and the suspension bolt are correspondingly threaded, so that the suspension bolt is rotated as it is inserted through the support plate. The use of a threaded connection reduces the likelihood that the suspension bolt will move out of alignment with the suspension band when it is not supporting the weight of the first pile cage. It is envisioned that the suspension bolt will be partially-fitted into the hole in the support plate prior to lifting of the second pile cage, and when the pile cages are correctly positioned the bolt can be tightened so as to project through the hole in the support plate and into alignment with the suspension band by use of a suitable socket and wrench. By using a long-armed socket the operator can keep his or her hands well away from the pile cages, which will significantly reduce the likelihood of injury in the event of inadvertent movement of one or both of the pile cages.

The use of a single bolt is expected to be sufficient to support the weight of a small pile cage. For example, it is believed that a single M16 bolt could support the weight of a 0.5 tonne pile cage. However, it is preferred that there are two or three bolts, particularly with larger and heavier pile cages. Three bolts are the optimum, even on very heavy pile cages, as three bolts will always share the weight of a suspended pile cage, whereas there will be some redundancy with four or more bolts unless the bolts and the suspension band are perfectly aligned. Even if two or more bolts are used, however, it may be preferred as a precaution that each bolt can individually support the weight of the lower cage(s), and this additional security can easily be achieved (at relatively low cost) by using appropriate bolts and related componentry.

Desirably, the cage bars of one of the first and second pile cages are caused to converge towards the centre of the pile cage at their ends, so that the pile cage tapers at one end. The tapering end of the pile cage can more easily be located within the end of the other pile cage.

The inventor has therefore recognised that with the present invention the cage bars of the first pile cage are not required to be aligned with, or to lie alongside, the cage bars of the second pile cage as is the case with the prior art methods described above, and the cage bars of one of the pile cages can therefore converge to facilitate the overlap between the cage bars of the respective pile cages. This has the additional advantage that less accuracy is required by the operator in ensuring that the cage bars of the respective pile cages are properly and accurately aligned, so reducing the time taken to splice the two pile cages together.

Preferably, the suspension band is a continuous loop around the first pile cage, the suspension band being approximately circular. Providing a continuous band reduces the accuracy required when the second pile cage is lowered relative to the first pile cage, since the angular orientation of the first pile cage relative to the second pile cage is unimportant.

Desirably, the suspension band is located around the inside of the cage bars of the first pile cage. Locating the suspension band around the inside of the cage bars reduces the likelihood that the suspension band will foul the cage bars or frame of the second pile cage.

Preferably, the support plate is located inside or alongside the cage bars in the second pile cage. This reduces the distance which must be spanned by the suspension bolt.

The suspension band is preferably welded or otherwise permanently secured to the cage bars of the first pile cage. Preferably the suspension band is secured to all of the cage bars so that when the pile cage is suspended from the suspension band all of the cage bars are directly supported. Alternatively, the suspension band is secured to only some of the cage bars, and the weight of the other cage bars is communicated to the suspension band by way of the frame(s) of the pile cage.

The or each support plate is preferably welded or otherwise secured to a single cage bar of the second pile cage. Alternatively, (and provided it will not foul the cage bars of the other pile cage) the support plate can be a loop or part-loop spanning all or a large part of the periphery of the second pile cage. In applications in which the weight of the first pile cage requires more than one suspension bolt, the or each support plate can have two or more holes therethrough for receiving two or more suspension bolts. Accordingly, three suspension bolts can be employed by using a single support plate arranged as a band around substantially the complete periphery of the second pile cage, the band having three holes therethrough, usefully separated by approximately 120° around the band.

The arrangement of the suspension band and the support plate can of course be reversed within the scope of the present invention, with the support plate mounted adjacent to the uppermost end of the lowermost pile cage and the suspension band mounted adjacent to the lowermost end of the uppermost pile cage, in which case the uppermost pile cage will be lowered until the suspension band is below the hole in the support plate prior to insertion of the suspension bolt.

There is also provided a set of components for use in a method for splicing together two pile cages, the set of components comprising: {i} a suspension band for fitment to a first pile cage, {ii} at least one support plate for fitment to a second pile cage, the or each support plate having a hole therethrough, and {iii} a suspension bolt for each of the support plates, the suspension bolt being sized for insertion into and through the hole in the support plate.

Furthermore, there is provided a first pile cage assembled from a number of cage bars and at least one frame, the pile cage having a suspension band secured to the cage bars adjacent to an end of the cage bars, and a second pile cage assembled from a number of cage bars and at least one frame, the pile cage having at least one support plate secured to a cage bar adjacent to an end of the cage bar, the support plate having a hole therethrough for receiving a suspension bolt.

In an alternative embodiment, the suspension band and the support plate can also be used to allow the lowermost pile cage to support the uppermost pile cage when the lowermost pile cage rests upon the bottom of the pile hole. Specifically, the support plate can be elongated in the direction of the longitudinal axis of the pile cages, and specifically elongated so that it is substantially longer than the axial length of the suspension band. The support plate has two holes therethrough, each of which can receive a respective bolt. In use, it is arranged that the second pile cage is lowered to a relative position in which the support plate spans the suspension band, and the bolts are inserted into their respective holes with one of the bolts lying below the suspension band and the other bolt lying above the suspension band. The first pile cage can then be lifted together with the second pile cage as previously described (i.e. with said one of the bolts engaging the bottom of the suspension band), and in addition the pile cages can be lowered to rest upon the bottom of the pile hole and the first pile cage can be supported by the second pile cage by virtue of said other bolt engaging the top of the suspension band.

In such embodiments, it is not necessary that the distance between the holes in the support plate, and therefore the distance between the inserted bolts, closely match the axial length of the suspension band, and it is preferred that the distance between the holes substantially exceeds the axial length of the suspension band so that there is some freedom in relative positioning of the pile cages during insertion of the bolts.

BRIEF DESCRIPTION OF THE DRAWINGS

The invention will be described, by way of example, with reference to the accompanying drawings, in which.

DETAILED DESCRIPTION

Figure 1:
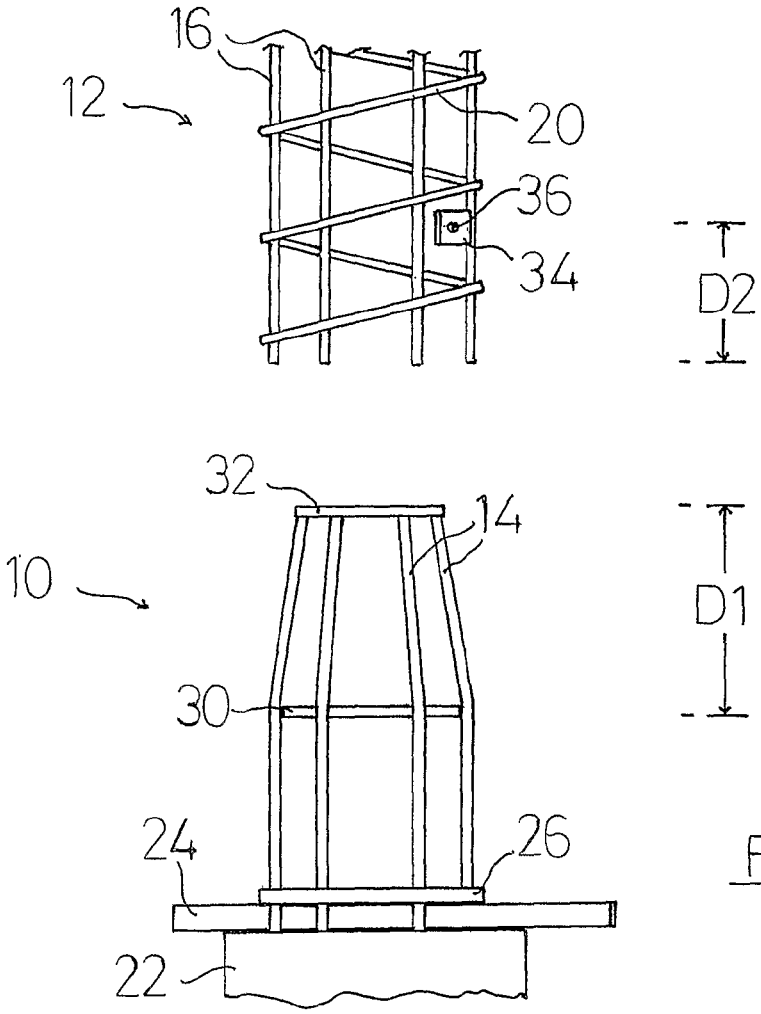
FIG. 1 is a side view of part of the first pile cage and part of the second pile cage during the performance of the method according to the present invention.

The present invention concerns a method of splicing together a first pile cage 10 and a second pile cage 12. In known fashion, the first pile cage 10 comprises a number of (in this embodiment six) cage bars 14 and at least one frame (not seen). The second pile cage similarly comprises a number of (in this embodiment also six) cage bars 16 and a frame 20. The frame 20 is a helical wire wound around the outside of the cage bars 16, and secured to the cage bars at each junction therebetween, in usual fashion.

It will be understood that the helical wire 20 is but one example of frame, and other frames such as those described in EP 0 608 068 (for example) may alternatively (or additionally) be used. The form of the frame or frames of each pile cage is not relevant to the present invention.

The helical wire 20 continues almost to the (lowermost) ends of the cage bars 16 of the second pile cage 12, but in other embodiments the helical wire can terminate at, or further away from, the ends of the cage bars, as desired.

The frame of the pile cage 10 may also be a helical wire similar to the helical wire 20, but in this embodiment the frame of the first pile cage 10 terminates a substantial distance away from the (uppermost) ends of the cage bars 14, so that the frame is hidden from view in this figure within the casing 22.

It will be understood that a casing is not essential to the present invention, but it is recognised that a casing will often be used when it is desired to splice pile cages together.

In common with prior art methods, the method according to the present invention comprises {i} assembling the first pile cage 10, {ii} lifting the first pile cage 10 until it is substantially coaxial with the casing 22, {iii} lowering this pile cage into the casing 22, and {iv} supporting the first pile cage 10 with its uppermost end projecting from the casing 22 as shown in FIG. 1. Also in common with prior art methods, the first pile cage 10 in this embodiment is supported upon the casing by way of a trapping bar 24 which is laid across the top of the casing 22 and underneath a trapping band 26 which is secured to the cage bars 14.

The trapping band 26 may be secured to the cage bars 14 in a desired position solely for the purpose of suspending it from the casing 22 and allowing the desired length of cage bars 14 to project from the casing 22, or it may additionally be configured to provide a frame for the pile cage 10 and/or one or more lifting points for the pile cage.

In the embodiment of FIG. 1, a suspension band 30 is located between the trapping band 26 and the ends of the cage bars 14. In this embodiment the suspension band 30 is a substantially circular strip of metal which lies inside the cage bars 14 and is welded to all of the cage bars 14. In alternative embodiments the suspension band may be secured by means other than welding, and/or it may be secured to only some of the cage bars 14, but since the pile cage 10 will typically be assembled at a dedicated manufacturing facility, welding the suspension band to all of the cage bars 14 is possible and preferred.

FIG. 1 shows a preferred feature of the invention, namely the tapering of the upper end of the first pile cage 10. The tapering is achieved by securing each of the cage bars to an end band 32 which is substantially circular and has a diameter less than the diameter of the trapping band 26 and suspension band 30. Accordingly, each of the cage bars 14 is forced to converge towards the longitudinal axis of the pile cage 10.

The tapered form of the pile cage 10 is not essential for the performance of the present invention, but is preferred because it facilitates the alignment of the second pile cage 12 with the first pile cage 10, and reduces the accuracy required of the crane operator, and can therefore reduce the time taken by the splicing operation.

When the first pile cage 10 has been lowered into the position shown in FIG. 1 the second pile cage 12 can be lifted into position above the first pile cage 10 and substantially coaxial therewith, as is also shown in FIG. 1. The second pile cage 12 is then lowered from the position shown in FIG. 1 until the respective cage bars 14, 16 overlap.

As above indicated, the spliced joint between the pile cages 10 and 12 is not required to transmit the tensile stress from the cage bars 14 to the cage bars 16 (and vice versa), and instead that stress is transmitted by way of the concrete which is subsequently set around the spliced joint. To allow the concrete to transmit the stress the cage bars 14 are required to overlap the cage bars 16 by a distance which depends upon several factors such as the diameter and length of the pile, the overlap distance will be determined in advance by the piling contractor or the pile cage manufacturer. It is desirable that the first pile cage 10 project above the casing 22 by a distance which is greater than the required overlap, so that the second pile cage 12 can lie totally above the casing 22 as the spliced joint is being formed, and there is no likelihood of any of the second pile cage 12 fouling the trapping bar 24.

Figure 2:
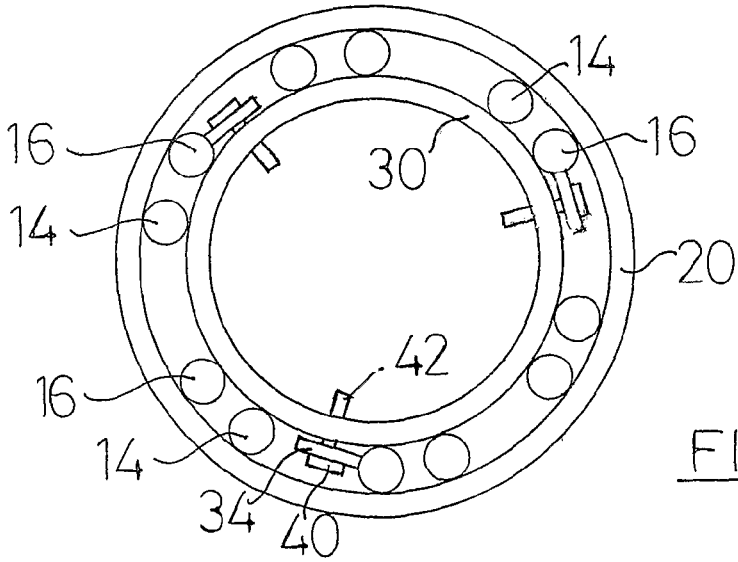
FIG. 2 is a plan view of alternative embodiments of first and second pile cages during a later stage of the method.

According to the embodiment of FIG. 1, adjacent to the lowermost end of the second pile cage 12 is located at least one support plate 34 (only one support plate 34 is shown in FIG. 1 for simplicity but the preferred arrangement of three support plates is shown in the embodiment of FIG. 2). The support plate 34 has a hole 36 therethrough, the hole in this embodiment being threaded. The threaded hole 36 can receive the shank of a correspondingly threaded bolt 40 (FIG. 2), the bolt not being shown in FIG. 1.

During the lowering of the second pile cage 12 from the position of FIG. 1, the cage bars 16 first pass around the end band 32 and the converging parts of the cage bars 14 and then between the cage bars 14 as they reach the end of the converging section, the helical wire 20 of the second pile cage 12 also surrounding the cage bars 14 of the first pile cage 10. The second pile cage 12 is lowered until the threaded hole 36 lies below the suspension band 30, whereupon the bolt 40 can be inserted and tightened until its end 42 lies within the projected area of the suspension band 30.

With the preferred threaded connection between the bolt 40 and the hole 36, the bolt will preferably be partially-inserted into the hole before the second pile cage 12 is lifted, so that the operator does not need to commence threading of the bolt 40 into the hole 36 whilst the second pile cage is suspended over the casing; requiring the operator merely to rotate the bolt whilst the second pile cage is suspended can be made a relatively safe operation. Alternatively (but less preferably) the bolt 40 may be fitted after the second pile cage 12 has been lifted, but in this case it is preferred that the head of the bolt is firstly located into a suitable socket and offered up to the hole by way of the socket. In both cases the socket can be connected to a wrench by a suitably long arm so that the operator does not need to place his or her hands close to the pile cages during the fitment of the bolt (if required), nor during the tightening of the bolt.

It will preferably be arranged that the bolt 40 must be fully tightened against the support plate 34, i.e. the bolt 40 is rotated until its head engages the support plate 34 and can be tightened thereagainst. The bolt 40 has a sufficiently long shaft to ensure that its end lies within the projected area of the suspension band when fully tightened, as shown in FIG. 2. This avoids any uncertainty for the operator in having to determine how far to insert the bolt, and ensures that the bolt can be made secure in its fully inserted position.

As above indicated, only one support plate 34 is shown in FIG. 1, having one hole 36 for receiving one bolt 40, and whilst such an arrangement may be suitable for a small pile cage weighing perhaps 0.5 tonnes, it is generally preferred to use two or three bolts. If two bolts are used they are preferably diametrically opposed around the second pile cage 12, and if three bolts are used they are preferably separated by approximately 120° around the second pile cage 12 as shown in FIG. 2. It will be understood that with only one or two bolts the first pile cage 10 could pivot relative to the second pile cage 12, but such pivoting will in any event be limited by the pile hole or casing and may be acceptable in certain applications.

When the bolt(s) 40 have been inserted and tightened against their respective support plates 34, their respective ends 42 will lie within the projected area of the suspension band 30, as shown in FIG. 2. The crane may then be used to lift the second pile cage slightly so as to move the bolts 40 into engagement with the underside of the suspension band, and further lifted so as to lift both the second pile cage 12 and the first pile cage 10 and allow removal of the trapping bar 24. The pile cages 10 and 12 (which are now spliced together as required) can then be lowered together into the casing 22.

Accordingly, it will be understood that with the present invention the splicing together of the pile cages 10 and 12 is achieved by way of an interference fit between the bolt(s) 40 and the suspension band 30, an interference fit being a much more secure and reliable interconnection that the friction fit offered by U-bolts for example.

As seen in FIG. 2, the suspension bolts 40 are directed towards the centre of the pile cages 10 and 12. It is not necessary that they are aligned with the exact centre of the pile cages, but the more accurate their alignment the shorter will be the distance the bolts must span in order to lie within the projected area of the suspension band 30.

In an alternative embodiment the support plate 34 is in the form of a band which is preferably circular and adapted to surround the cage bars 14. The band can have the desired number of holes formed therethrough. Providing a band which surrounds the cage bars is expected to make it easier to ensure that the holes through the support plate are more accurately directed towards the centre of the pile cage.

Alternatively and/or additionally, the hole(s) 36 in the support plate can be provided by nuts which are secured (suitably fillet welded) to the support plate. The nuts are located upon the support plate adjacent to openings in the support plate through which the bolt can pass. Accordingly, it is not necessary to provide threaded holes in the support plate, but merely to provide one or more holes in the support plate which are large enough to allow the bolt(s) to pass through, and then secure dedicated nuts to the support plate. It is expected to be easier to align the axis of a dedicated nut to the centre of the pile cage than the axis of a threaded hole in the support plate, and this embodiment will in any event avoid the requirement for dedicated tooling to create the threaded hole in the support plate, and subsequently to mount the support plate with the correctly-aligned threaded holes.

In other embodiments, the support plate can be extended in the longitudinal direction of the pile cage, and can be provided with two holes spaced in the longitudinal direction. The holes should be spaced by a distance at least as great as the longitudinal dimension of the suspension band, whereupon a bolt can be inserted through each of the holes, one lying below the suspension band as above described, the other lying above the suspension band. The bolt which lies below the suspension band allows the first pile cage to be lifted with the second pile cage as described above. The bolt which lies above the suspension band allows the second pile cage to rest upon the first pile cage, as will occur when the spliced pile cage has been lowered to the bottom of the pile hole.

Alternatively, the bolts which lie below and above the suspension band respectively can be mounted in holes in separate support plates, if desired.

It will also be understood that the cage bars 14 play no part in the splicing operation, so that the position of the cage bars 14 relative to the cage bars 16 is not important, and less (or substantially no) accuracy is required in the angular alignment of the respective pile cages.

If desired or required, a third pile cage can be spliced to the upper end of the second pile cage 12, and so on, in similar fashion.

Figure 3:
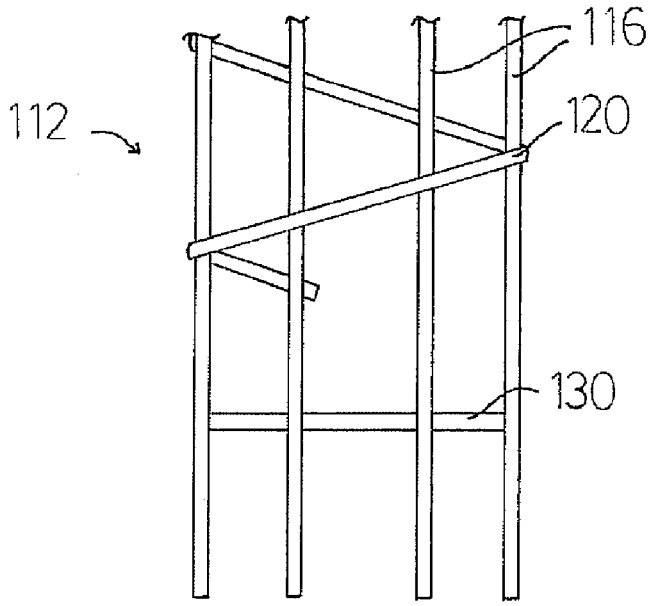
FIG. 3 is a view similar to that of FIG. 1 of an alternative design of first pile cage and second pile cage during the performance of the method according to the present invention.
Figure 3:
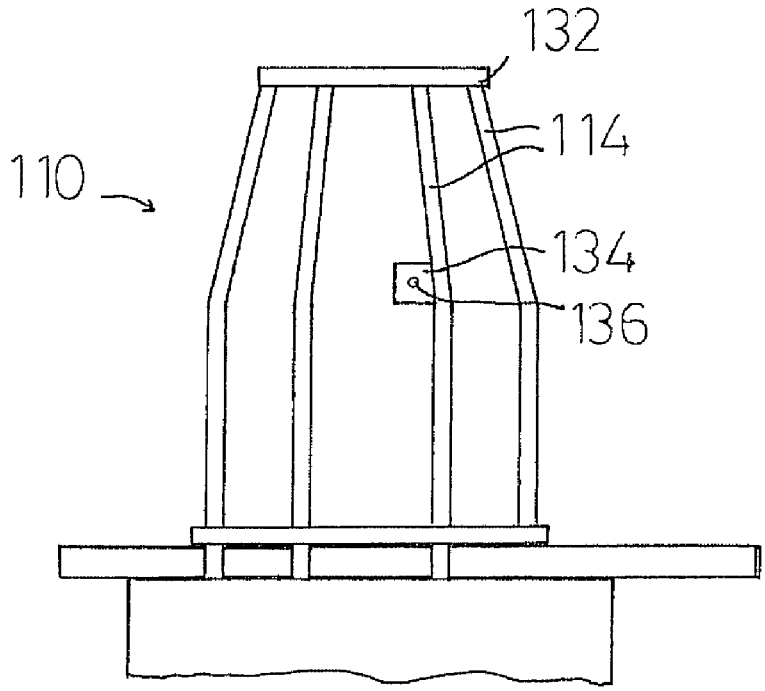

It will be understood that the locations of the suspension band 30 and the support plates 34 could be reversed without detriment, i.e. the suspension band could be located on the lowermost end of the second pile cage and the support plate could be located on the uppermost end of the first pile cage, as in the embodiment of FIG. 3.

In the embodiment of FIG. 3 the first pile cage 110 comprises a number of (in this embodiment six) cage bars 114 and at least one frame (not seen). The second pile cage 112 similarly comprises a number of (in this embodiment also six) cage bars 116 and a frame 120.

When the first pile cage 110 has been lowered into the position shown in FIG.3 the second pile cage 112 can be lifted into position above the first pile cage 110 and substantially coaxial therewith, as is also shown in FIG. 3. The second pile cage 112 is then lowered from the position shown in FIG. 3 until the respective cage bars 114, 116 overlap.

In this embodiment, adjacent to the lowermost end of the second pile cage 112 is located a suspension band 130. During the lowering of the second pile cage 112 from the position of FIG. 3, the cage bars 116 first pass around the end band 132 and the converging parts of the cage bars 114 and then between the cage bars 114 as they reach the end of the converging section, the helical wire 120 of the second pile cage 112 also surrounding the cage bars 114 of the first pile cage 110. The second pile cage 112 is lowered until the suspension band 130 lies below the threaded hole 136 in the support plate 134, whereupon a bolt (similar to the bolt 40 of FIG. 2) can be inserted and tightened until its end lies within the projected area of the suspension band 130.

In the embodiment shown in FIG. 1 the suspension band 30 is located upon the first pile cage 10 so that its lower edge is a distance D1 from the ends of the cage bars 14 and the support plate 34 is located so that the top edge of the hole 36 is a distance D2 from the ends of the cage bars 16. When the pile cages 10 and 12 have been spliced together, the overlapping length of the cage bars 14 and 16 is the sum of D1 and D2, and it is arranged that this overlapping length matches (or exceeds) the overlap distance required for the spliced joint, and in particular the overlap required for the concrete which is to be set around the spliced joint to transmit the tensile stress from the cage bars 14 to the cage bars 16 and vice versa.

Also in the embodiment shown the number of cage bars in, and the diameters, of the pile cages 10 and 12 are the same, but this is not necessarily so, and in practice the number of cage bars and/or the diameters of the pile cages can differ. Clearly, the location of the suspension band and the support plate(s), and the length of the suspension bolts, will be chosen to suit the particular pile cages which are to be spliced.

I claim:

1. A method of splicing comprising the steps of: {i} assembling a first pile cage from a number of cage bars and at least one frame, the first pile cage having a suspension band adjacent to one of its ends, {ii} assembling a second pile cage from a number of cage bars and at least one frame, the second pile cage having at least one support plate adjacent to one of its ends, the support plate having a hole therethrough {iii} lifting the first pile cage and lowering this pile cage into a pile hole with its end having the suspension band uppermost, {iv} supporting the first pile cage with its uppermost end projecting from the pile hole and with the suspension band accessible, {v} lifting the second pile cage above the first pile cage and substantially coaxial therewith, with the end having the support plate lowermost, {vi} lowering the second pile cage relative to the first pile cage until a part of the cage bars of the second pile cage overlap a part of the cage bars of the first pile cage, and the hole in the support plate lies below the suspension band, {vii} inserting a suspension bolt through the hole in the support plate so that a part of the suspension bolt lies underneath a part of the suspension band, whereby the first and second pile cages can be lifted together with the suspension bolt engaging the suspension band.

2. A method according to claim 1 in which the hole in the support plate and the suspension bolt are correspondingly threaded.

3. A method according to claim 2 in which the suspension bolt is partially-fitted into the hole in the support plate prior to lifting of the pile cage.

4. A method according to claim 1 in which there are holes for three suspension bolts.

5. A method according to claim 1 in which the cage bars of one of the first and second pile cages are caused to converge towards the centre of the pile cage at their ends, so that the pile cage tapers at one end.

6. A method according to claim 1 in which the suspension band is a continuous loop around the first pile cage, the suspension band being approximately circular.

7. A method according to claim 6 in which the suspension band is located around the inside of the cage bars of the pile cage.

8. A method according to claim 1 in which the support plate is located inside or alongside the cage bars in the second pile cage.

9. A method according to claim 1 in which the support plate is a band spanning all or a large part of the periphery of the pile cage.

10. A method of splicing comprising the steps of: {i} assembling a first pile cage from a number of cage bars and at least one frame, the first pile cage having at least one support plate adjacent to one of its ends, the support plate having a hole therethrough {ii} assembling a second pile cage from a number of cage bars and at least one frame, the second pile cage having a suspension band adjacent to one of its ends {iii} lifting the first pile cage and lowering this pile cage into a pile hole with its end having the support plate uppermost, {iv} supporting the first pile cage with its uppermost end projecting from the pile hole and with the support plate accessible, {v} lifting the second pile cage above the first pile cage and substantially coaxial therewith, with the end having the suspension band lowermost, {vi} lowering the second pile cage relative to the first pile cage until a part of the cage bars of the second pile cage overlap a part of the cage bars of the first pile cage, and the suspension band lies below the hole in the support plate, {vii} inserting a suspension bolt through the hole in the support plate so that a part of the suspension bolt lies underneath a part of the suspension band, whereby the first and second pile cages can be lifted together with the suspension bolt engaging the suspension band.

11. A method according to claim 10 in which the hole in the support plate and the suspension bolt are correspondingly threaded.

12. A method according to claim 11 in which the suspension bolt is partially-fitted into the hole in the support plate prior to lifting of the pile cage.

13. A method according to claim 10 in which there are holes for three suspension bolts.

14. A method according to claim 10 in which the cage bars of one of the first and second pile cages are caused to converge towards the centre of the pile cage at their ends, so that the pile cage tapers at one end.

15. A method according to claim 10 in which the suspension band is a continuous loop around the first pile cage, the suspension band being approximately circular.

16. A method according to claim 15 in which the suspension band is located around the inside of the cage bars of the pile cage.

17. A method according to claim 10 in which the support plate is located inside or alongside the cage bars in the second pile cage.

18. A method according to claim 10 in which the support plate is a band spanning all or a large part of the periphery of the pile cage.

19. A first pile cage assembled from a number of cage bars and at least one frame, the pile cage having a suspension band secured to the cage bars adjacent to an end of the cage bars, and a second pile cage assembled from a number of cage bars and at least one frame, the second pile cage having at least one support plate secured to a cage bar adjacent to an end of the cage bar, the support plate having a hole therethrough for receiving a suspension bolt, the suspension band and the support plate being located upon the respective cage bars so that when the first pile cage and the second pile cage are positioned with the suspension band adjacent to the support plate the cage bars of the first pile cage overlap the cage bars of the second pile cage.

* * * * *